United States Patent [19]

Crabb et al.

[11] 4,277,964

[45] Jul. 14, 1981

[54] DOOR LOCK

[75] Inventors: Elmer R. Crabb, Aurora; Alta M. Parr, Peoria, both of Ill.

[73] Assignee: Caterpillar Tractor Co., Peoria, Ill.

[21] Appl. No.: 30,242

[22] PCT Filed: Feb. 15, 1979

[86] PCT No: PCT/US79/00088

§ 371 Date: Feb. 15, 1979

§ 102 (e) Date: Feb. 15, 1979

[87] PCT Pub. No: WO80/01703

PCT Pub. Date: Aug. 21, 1980

[51] Int. Cl.[3] ..... E05B 55/04

[52] U.S. Cl. ..... 70/484; 70/489; 70/153; 292/153; 292/DIG. 23

[58] Field of Search ..... 70/478–481, 70/483–486, 489, 153; 292/21, 92, 153, 210, DIG. 23, DIG. 24

[56] References Cited

U.S. PATENT DOCUMENTS

| | | | |
|---|---|---|---|
| 752,624 | 2/1904 | La Belle | 70/483 X |
| 941,327 | 11/1909 | Manning | 292/153 X |
| 1,611,838 | 12/1926 | Malicki | 70/486 X |
| 1,908,958 | 5/1933 | Coffron | 292/169.16 |
| 2,238,066 | 4/1941 | Mantz | 70/483 X |
| 2,665,157 | 1/1954 | De Vito | 292/DIG. 24 |
| 2,682,763 | 7/1954 | Williams | 70/211 |
| 2,700,886 | 2/1955 | Welch | 70/479 X |
| 3,750,433 | 8/1973 | Sanders | 70/486 |
| 4,072,331 | 2/1978 | Butterfield et al. | 292/173 |

*Primary Examiner*—William E. Lyddane

*Attorney, Agent, or Firm*—Wegner, Stellman, McCord, Wiles, Wood & Dalton

[57] ABSTRACT

A vehicle door latch assembly (16) is provided whereby a key (104) may be used to lock the door (10) and to prevent rotation of the outside door handle (20). A lock release lever (22) is provided inside the vehicle door for overriding the key lock (103) to permit the inside and outside handles (18,20) to operate to open the door. Even with the lock release lever (22) and the key lock (103) in the locked position, the inside handle (18) can be turned to move the lock release lever (22) to the unlocked position and to open the door. The outside handle (20) can now be used to open the door also. The outside handle (20) can also be released for operation by turning the key (104) in the lock (103) to the unlocked position.

20 Claims, 5 Drawing Figures

DOOR LOCK

DESCRIPTION

1. Technical Field

This invention relates to door locks and, more particularly, to a door lock having a lock release apparatus operative from the inside of the vehicle.

2. Background Art

Current cabs, for instance, on tractors for bulldozers and the like, are locked from the outside using a key. The locks are such that they cannot be unlocked or operated from inside the cab when locked. In the event only one door is unlocked, it is possible for an operator to be trapped in the cab if the cab gets pinned with the unlocked door obstructed and unusable.

U.S. Pat. No. 2,682,763 to Williams shows a garage door latch which is key locked from the outside, but has a slide mechanism on the inside which can be actuated on the inside to release the latch.

U.S. Pat. No. 1,908,958 to Coffron shows a door latch which can be released from the inside and can have the bolt disconnected from the outside handles so that the outside handle will turn without moving the bolt.

DISCLOSURE OF INVENTION

In one aspect of the present invention, a lock assembly is provided for a vehicle having a door jam, a door having an outside and an inside panel, and a latch structure for latching and locking said door to said door jam. The latch structure has a handle extending through the outside panel with a lock ring keyed thereon. A pair of spaced apart ears projects from the lock ring with one of the ears engaging a lug or stop carried by the door. A second handle has a latch ring keyed thereon which is coaxially aligned with the lock ring and is rotatably mounted relative thereto. The latch ring moves a latch to unlatch the door from the door jam. A spring is provided for resiliently holding the latch in the latched position. A pair of abutting surfaces is provided on the latch ring with one of said abutting surfaces engaging with said one of said ears on the lock ring. A lever is pivotally mounted relative to the door and has a cutout in alignment with the other of said ears on said lock ring when said lever is in the locked position. A linkage is provided for connecting the lever to a key lock. The linkage has a tumbler lever engaging with a portion of the key lock either to selectively operate said key lock or to be selectively operated by said key lock. A second spring urges said lever into either a locked or unlocked position, whereby locking said key lock will operate to move said lever into position to align said cutout on the lever with said other ear on said lock ring thereby preventing the lock ring and outside handle from moving in either direction. In the locked position, a cam surface on the lever contacts the said one of the abutting surfaces on the latch ring so that turning the second handle clockwise will move said one of the abutting surfaces on the latch ring against the cam surface on the lock lever to pivot the lock lever and latch structure to the unlocked and unlatched position.

A latch is provided for vehicles and the like which is operative from the outside and from the inside. When the latch is locked from the outside, it can be opened in either of two ways from the inside. First, by actuating a lock release lever which overrides the key lock and permits the latch to be opened by turning either the inside or the outside handle. Secondly, with the lock lever in the locked position, the inside handle can be operated which will throw the lock release lever to the unlocked position so that either the inside or outside handle can be used. In either the first or second condition, once the lock lever is put in the locked position, the door is once again locked from the outside until the key is used to reset the lock in the unlocked position. There is also a third condition whereby with the key lock unlocked, the door can be locked by putting the lock release lever in the locked position whereupon the outside handle will not be operative and the door is locked.

The improved latch arrangement provides safety and security with a relatively simple structure that is durable and long lasting.

BEST MODE FOR CARRYING OUT THE INVENTION

Figure 1:
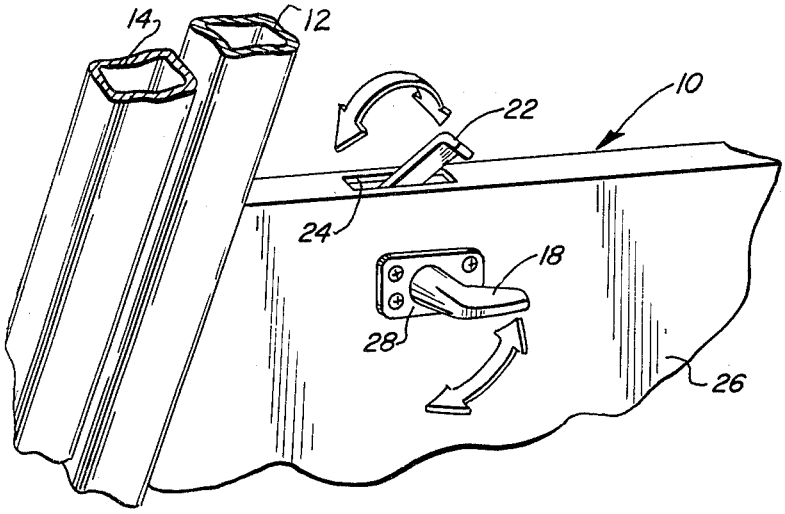
FIG. 1 is a broken away perspective view of a door and door frame using our improved door latch structure.
Figure 2:
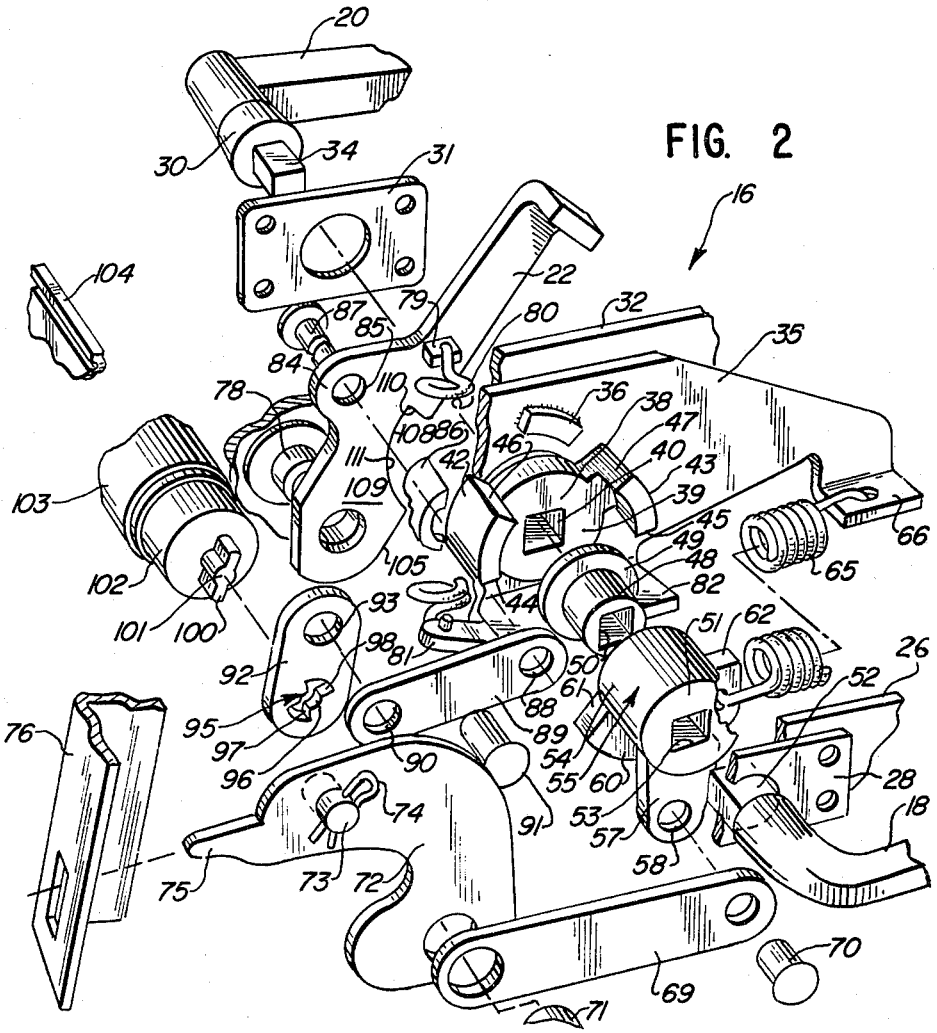
FIG. 2 is an exploded view of the improved door latch structure of FIG. 1.

Referring to the drawings wherein there is illustrated a preferred form of our invention, a vehicle door 10 closes against and latches to the door jam 12 mounted on the vehicle frame 14. The door 10 has a door latch structure 16 shown in an exploded view in FIG. 2 with an inside handle 18, an outside handle 20 and a lock release lever 22. As illustrated in FIGS. 1 and 2, the lock release lever 22 projects through an opening 24 in the top edge of the door 10 with the handle 18 passing through the door panel 26 and being held thereagainst by the handle plate 28. The outside handle 20 has a shaft 30 which passes through a latch plate 31 secured against the outside door panel 32. The inner end portion 34 of the handle shaft 30 is square in cross section and extends through an aperture 33 (FIG. 3) in a plate assembly 35, which plate assembly 35 is secured to the inside of the door panel 32. The plate assembly 35 has an inwardly projecting lug or stop 36 integrally formed therewith or welded thereon at a location just above and slightly to the right of the aperture 33 through which the shaft 30 of the outside handle 20 passes.

A lock ring 38 has a body portion 39 through which a square aperture 40 extends. The aperture 40 is adapted to receive the square end portion 34 of the shaft 30 so that rotation of the outside handle 20 will rotate the lock ring 38. The body portion 39 of the lock ring 38 has a pair of radially disposed and axially extending spaced apart ears 42 and 43. Each ear 42,43 is a segment of a circle which is concentric with the circular shape of the body portion 39. The ears 42 and 43 have end edges 44 and 45, respectively, which are shown facing downwardly and which lie in a plane along a diameter of the lock ring 38. The ears 42 and 43 have end edges 46,47, respectively, facing upwardly with the end edge 47 aligning with the one radial end face of the lug 36 on the plate assembly 35 and is adapted to contact said end face of the lug 36 under certain conditions of use of the latch arrangement. With the lock ring 38 mounted on the square end 34 of the shaft 30, it is positioned close to the plate assembly 35. A bushing 48, which is cylindrical in shape and has an enlarged flanged end portion 49 on one end thereof, has a square aperture 50 extending axially through the center thereof. The bushing 48 is, likewise, adapted to seat on the square end 34 of the shaft 30 so as to rotate with the handle 20.

Figure 3:
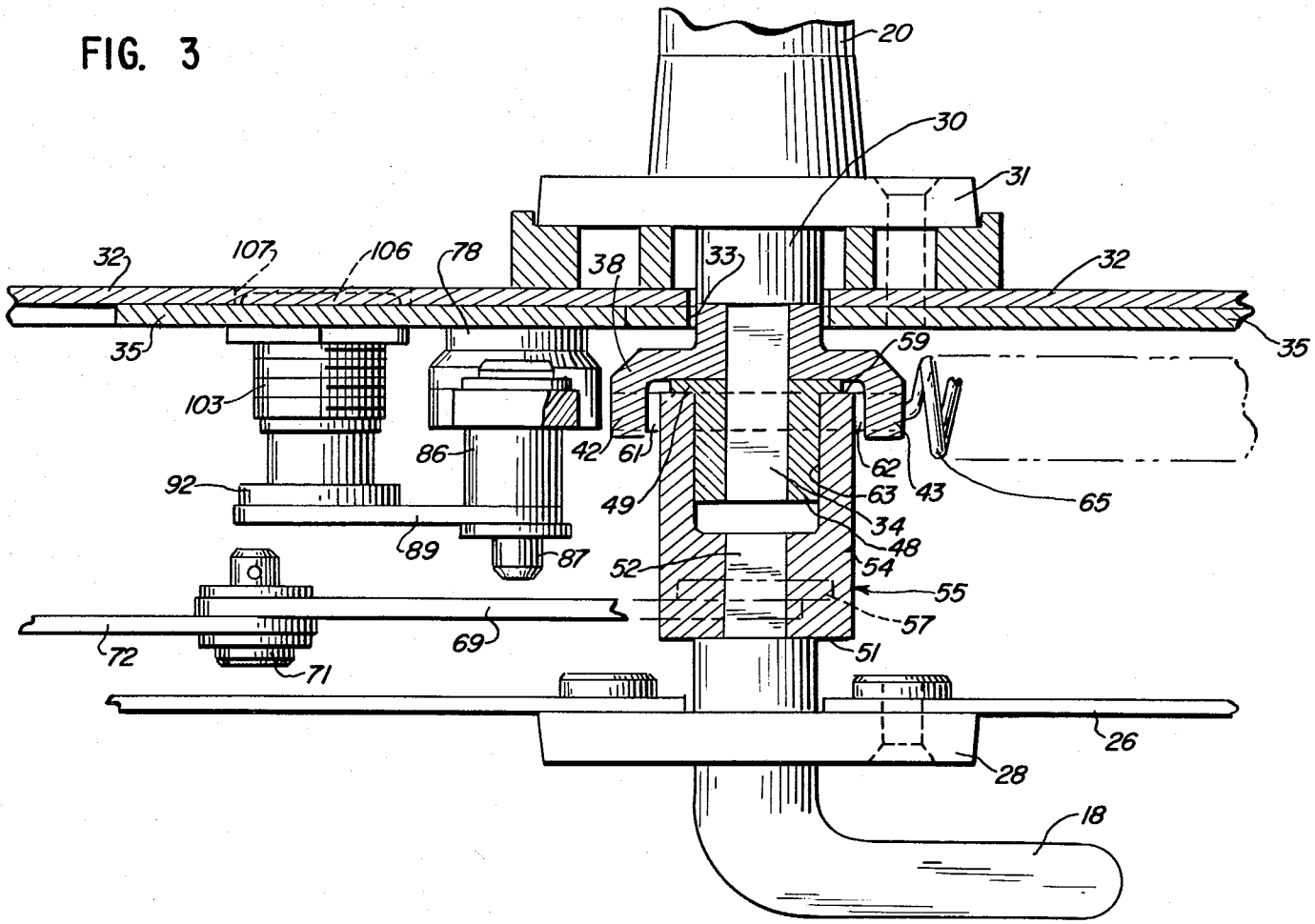
FIG. 3 is a partial cross-sectional view taken along the lines 3—3 of FIG. 4.

The inside handle 18 has a shaft 52 which is square and extends inwardly into the housing in the door 10 and is received in a square aperture 53 formed into one axial end 51 of the body portion 54 of a latch ring 55 so that rotation of the handle 18 will rotate the latch ring 55 about the axis of the shaft 52. An integrally formed, transversely extending leg 57 extends from the body portion 54 and has an aperture 58 through the outer end portion thereof. A radially, outwardly extending integrally formed segment of a collar 60 projects from the body portion 54 and has at each end thereof radially facing abutments or contact surfaces 61 and 62 lying along axes that form radii from the center of the body portion 54. The segment of the collar 60 extends through an arc of approximately 120° along the outer circumference of the body portion 54. As shown in FIG. 3, an outer axial end 59 of the body portion 54 has a cylindrical bore 63 which is adapted to receive the cylindrical portion of the bushing 48 for relative rotation therewith.

The latch ring 55 is rotatably mounted on the bushing 48 in line with the lock ring 38, so that the squared shaft 52 on handle 18 aligns with the square portion 34 on shaft 30 of the outside handle 20. As described, the handles 18 and 20 can be rotated independent of each other. A spring 65 extends from one end of the collar 60 to an inturned tab 66 on the plate assembly 35. The spring 65 is intended to hold the inside handle 18 substantially horizontal with the projecting leg 57 on the latch ring 55 extending transversely downward therefrom.

A link 69 is pivotally mounted to latch ring 55 by pin 70 extending into aperture 58 in the leg 57 and is pivotally mounted to a bellcrank 72 by a pin 71. The bellcrank 72 is pivoted to the door by pin 73 and a cotter key 74. The bellcrank 72 has an outwardly extending finger 75 which engages with a bolt or bar 76 for actuating the latch for unlatching the door 10 from the jam 12 of the door frame. It can be seen that rotating the handle 18 in a clockwise direction will pivot the leg 57 and link 69 to rotate the bellcrank 72 about the axis of the pivot pin 73 to move the finger 75 upward to actuate the latch to release the door latch arrangement. Release of the handle 18 will permit the spring 65 to return the handle to the horizontal position, lowering the finger 75 on the bellcrank 72 whereupon the door can be closed and latched again.

The lock release lever 22 is pivoted at one end portion to a boss 78 mounted on the plate assembly 35. A lug 79 is secured to an intermediate portion of the lock release lever 22 and has a spring 80 connected at one end to said lug 79 with the other end of the spring 80 being connected to a projection 81 carried by a platform 82 formed integral with and extending transverse to the plate assembly 35. An ear 84 on the one side of the central portion of the lock release lever 22 has an aperture 85 therethrough. A spacer 86 is received on a pin 87 passing through the aperture 85 in the lock release lever 22, which pin 87 then passes through an aperture 88 in a link 89 so as to space the link 89 from the ear 84 on the lock release lever 22. The link 89 has the other end portion apertured at 90 through which a pin 91 passes for connecting the link 89 to the tumbler lever 92. The pin 91 is received in an aperture 93 in one end portion of said tumbler lever 92. The tumbler lever 92 has, on the other end portion thereof, a butterfly-shaped opening 95 which has a circular center portion 96 and two outwardly flared segments of a circle 97 and 98 which are evenly divided on opposite sides of a diameter through said central portion 96. The butterfly opening 95 receives a bar 100 mounted on a pin 101 extending from the barrel 102 of the key lock mechanism 103. A key 104 is inserted in the lock 103 and, when turned, will turn the bar 100 about the axis of the pin 101. The key lock mechanism 103 is secured to the plate assembly 35 and has a mounting flange 106 opening outwardly through an aperture 107 formed in the outside door panel 32 of the door.

The edge 105 of the lock release lever 22 opposite the ear 84 has a cut out notch 108 and a cam 109 formed therein. That is, notch 108 is defined by a wall 110 extending transverse to the edge 105 of the release lever 22 which wall 110 is connected to an arcuately curved portion 111 which joins at approximately a right angle with a tangent line from the lower portion of the lock release lever 22 to form the cam 109 at said junction. It will be noted in FIG. 4, that the curved portion 111 is arcuate in shape and has a center 113 which does not coincide with the center of the shaft 52 of the outside handle 20. Due to the mislocation of the center 113 of the arcuately curved portion 111 of the release lever 22, the cam 109 on the release lever 22 will project into the space between the edge 44 of the ear 42 on the lock ring 38 and the surface 61 on the collar 60 of the latch ring 55. The ear 42 of the lock ring 38 nests in the cut out notch 108 with the spring 80 holding the lock release lever 22 against the lock ring 38 to prevent actuation of the outside handle 20 of the latch assembly. That is, with the lock release lever 22 in the position shown in FIG. 4, the ear 42 is nested in the cut out notch 108 in said lock release lever 22 and, at the same time, the ear 43 bears against the lug 36 mounted on the plate assembly 35. Any attempt to rotate the outside handle 20 will be stopped by the transverse wall 110 of the cut out notch 108 in the lock release lever 22, or by the lug 36 on the plate assembly 35.

Figure 4:
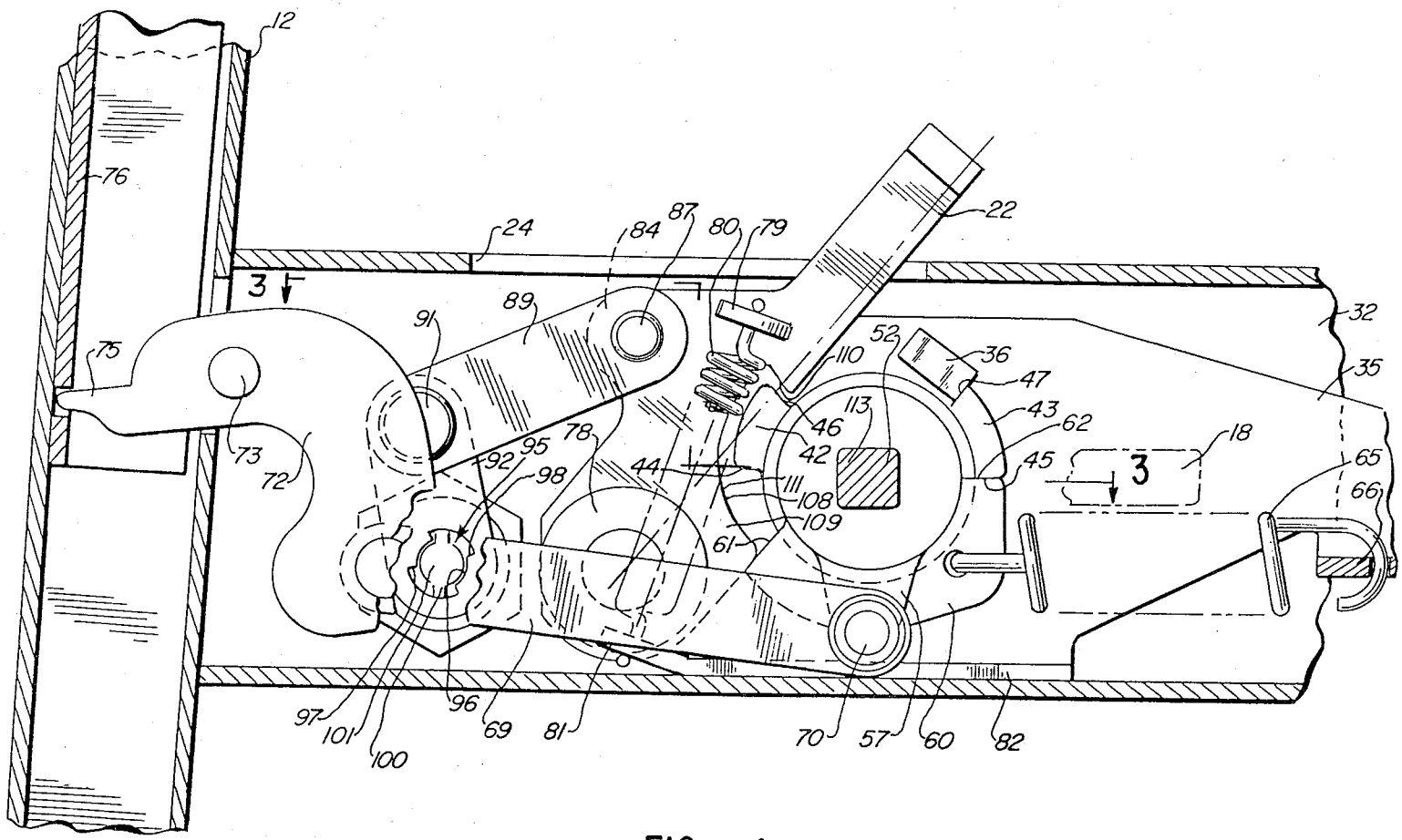
FIG. 4 is an elevational view of our improved door latch structure with the lock locked and the lock release lever in the latched position.
Figure 5:
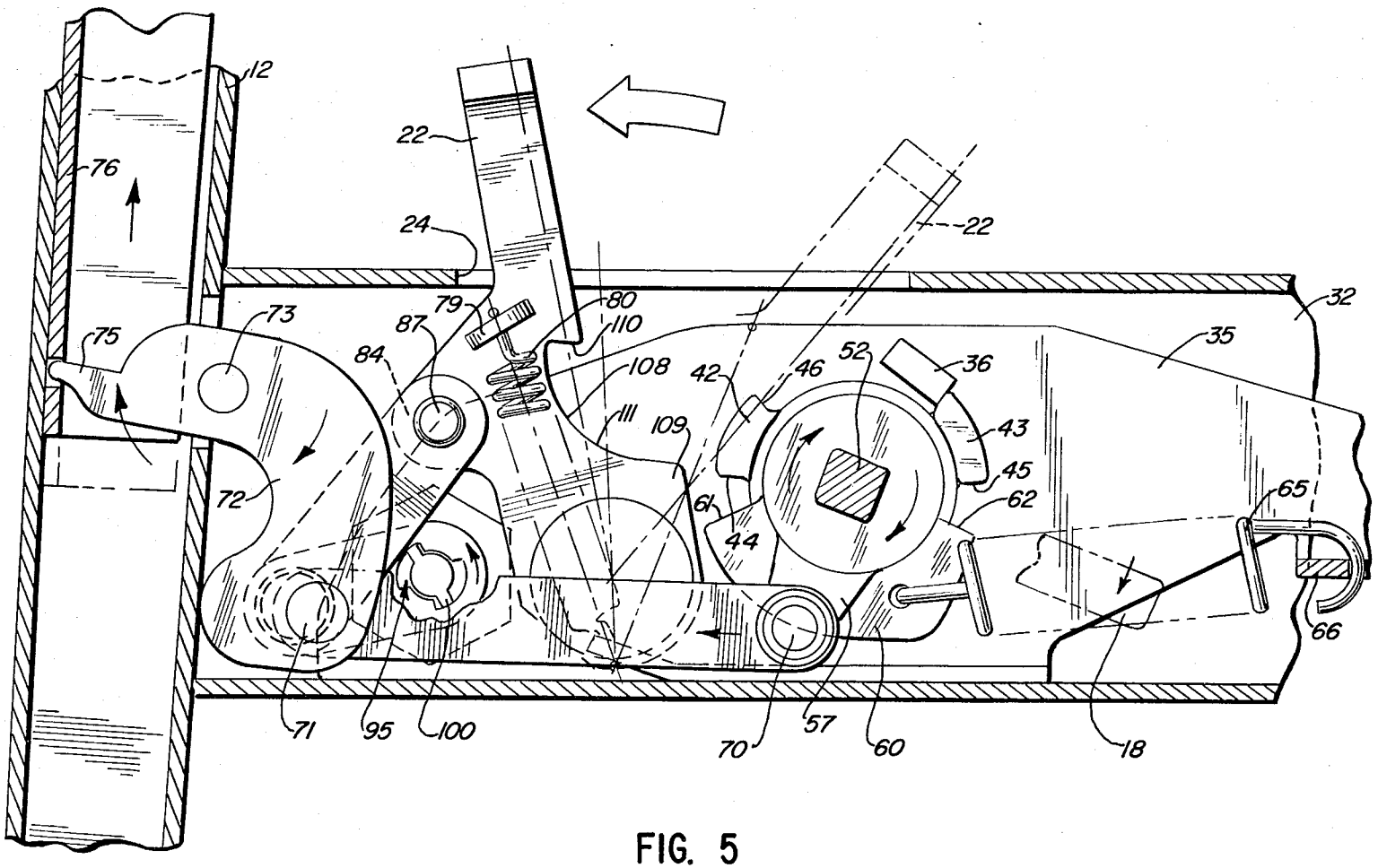
FIG. 5 is an elevational view of the same structure as FIG. 4 only with the lock release lever shown moved to the unlatched position.

The latch assembly can be operated from within the vehicle in one of two ways, either, first, by rotating the handle 18 in a clockwise direction, or, second, by pivoting the lock release lever 22 in a counterclockwise direction from the position of FIG. 4. Operation of the latch mechanism by turning of the handle 18 will be described first wherein upon rotating the handle 18 in the clockwise direction, the latch ring 55 is rotated to engage the surface 61 on the collar 60 against the cam 109 on the lock release lever 22. Simultaneously, the leg 57 on the latch ring 55 will urge the link 69 toward the left to rotate the bellcrank 72 about the pin 73. Continued movement of the handle 18 will move the latch ring 55 and collar 60 against the cam 109 of the lock release lever 22 to rotate the release lever 22 about the boss 78 until the axis of the spring 80 passes over the center line of the release lever 22 whereupon the spring 80 will throw the lock release lever 22 completely to the left to the position of FIG. 5. Simultaneously with the actuation of the latch release lever 22 by the collar 60 of the latch ring 55 will be actuation of the finger 75 on the bellcrank 72 by the link 69 to release the latch from the door jam 12. The counterclockwise movement of the lock release lever 22 by the latch ring 55 urges the link 89 and the tumbler lever 92 in a counterclockwise direction with respect to the bar 100 on the barrel 102 until one pair of aligned walls in the segments 97 and 98 of the butterfly opening 95 engage with the bar 100 to rotate the bar in a counterclockwise direction to the position of FIG. 5. The movement of the bar 100 will unlock the key lock 103. The movement of the release lever 22 to the left will remove the wall 110 of the cutout 108 from alignment with the ear 42 whereupon the outside handle 20 can now be used to unlatch the door 10 from the jam 12. Both the inside and outside handles 18 and 20, respectively, can now be used to actuate the latch to unlatch the door from the jam.

When the handle 18 is moved clockwise from the position shown in FIGS. 2 and 4 to move the lock release lever 22 toward the left until the center of the spring 80 moves past the center line of the lever, the spring 80 will complete the movement of the lock release lever 22 to the left to disengage the locking function from both the inside and the outside handles. Counterclockwise rotation of the tumbler lever 92 caused by the link 89 and the latch release lever 22 will bring the one pair of aligned walls of the segments 97 and 98 of the butterfly opening 95 into contact with the bar 100 of the lock 103 and will rotate the bar 100 and the tumblers within the lock so as to unlock the lock 103, as is shown in the solid line position of FIG. 5. The lock, with respect to the outside handle 20, can be reactivated by moving the lock release lever 22 to the position of FIG. 4 whereby the cutout 108 prevents rotation of the lock ring 38 as does the lug 36 on the plate assembly 35. The lock can also be actuated from the solid line position of FIG. 5, by inserting the key 104 in the lock 103 and, upon rotating the key, will rotate the bar 100 to engage the aligned walls of the segments 97 and 98 of the butterfly opening 95 in the tumbler lever 92 to rotate the tumbler lever 92, link and lock release lever 22 in a clockwise direction until the spring 80 passes over the center line whereupon the spring will complete the movement of the lock release lever 22 and affect the locking of the outside handle 20. Likewise, the lock can be disengaged from the outside by inserting the key 104 in the lock 103 and rotating in a direction to turn the bar 100 against one pair of walls of the segments 97 and 98 of the butterfly opening 95 so as to move the tumbler lever 92, link 89 and lock release lever 22 in a counterclockwise direction until the spring 80 passes over the center line whereupon the spring 80 will complete the unlocking of the device by moving the lock release lever 22 to the left along with the movement of the bar 100 by the key 104 to the unlocked position of FIG. 5.

The improved latch assembly is installed in any door arrangement where it is desirable to release the latching function of the door from the inside. One such application is in the heavy equipment area, such as on cab doors for tractors for bulldozers and the like. Most such cabs have two doors and with our device, both doors can be locked from the outside. To gain access to the cab, a key 104 is inserted in the lock 103 and is rotated to move the lock release lever 22 to the unlocked position whereupon the outside handle 20 can be used to unlatch the door. Once inside the cab, it is not necessary for the operator to go outside to unlock the other door since merely by moving the lock release lever 22 of the other door from the locked to the unlocked position, the other door is made functional for opening and closing from the inside and from the outside. In the event the operator fails to disengage the lock release lever 22 on one of the doors, the inside handle 18 can still be operated by turning the handle 18 in the usual manner which will cause the surface 61 of the collar 60 on the latch ring 55 to engage with the cam 109 on the lock release lever 22 to rotate the lock release lever 22 to a point where the center of the spring passes over the center line connecting the spring and the pivot axis of the lever whereupon the lock release lever 22 is moved by the spring 80 to the unlatched position. Continued movement of the handle 18 will move the link 69 and bellcrank 72 to release the latching assembly.

Details of the latch itself between the door and the door frame are not described in detail because any and all latch arrangements are intended to be used with the present construction. The finger 75 on the bellcrank 72 is used to move the bar of the latch to disengage the latch from its connection to the frame. Closing the door will re-engage the latch with the frame in a conventional fashion.

The latch assembly of the present invention provides for locking the door from the outside with a key or by placing the lock release lever in the locked position prior to closing the door whereupon the door will be secured from the outside. The door can be opened by use of a key from the outside or by turning the inside handle 18 which will disengage the lock release lever and the key lock arrangement.

Other aspects, objects and advantages of this invention can be obtained from a study of the drawings, disclosure and appended claims.

We claim:

1. A lock assembly for a door (10) for a vehicle having a latch structure (16) for latching and locking said door (10), aligned first and second handle means (20,18) extending outwardly and inwardly from opposite sides of said door (10), locking means (22) carried by said door (10) and having an operator-manipulated lever (22) movable between a locked and an unlocked position, cam means (108) operatively connected to said lever (22) and having one portion (110) engaging with a segment (42) of the first of said handle means (20) for preventing said first handle means (20) from being turned when said lever (22) is in the locked position, said cam means (108) having a second portion (109) engaging with a segment (60) on said second handle means (18) when said lever (22) is in said locked position, said second handle means (18) moving said segment (60) against said second portion (109) of the cam means (108) to simultaneously move the first portion (110) of the cam means (108) out of engagement with the first handle means (20) and to move the lever (22) to the unlocked position, said segments (42,60) of said first and second handle means (20,18) being aligned to engage one another when said first handle (20) is moved, and means (57) for connecting said second handle means (18) to said latch structure (16).

2. A lock assembly as claimed in claim 1 wherein said first handle means (20) is an outside handle (20) and said second handle means (18) is an inside handle (18).

3. A lock assembly as claimed in claim 1 wherein said cam means (108) is located on the lever (22) with said one portion (110) being a wall (110) of a cutout (108) and said first handle means (20) has an ear (42) engaging with said wall (110) to prevent said first handle means (20) from being rotated.

4. A lock assembly as claimed in claim 1 wherein said cam means (108) is located on said lever (22) with said second portion (109) being a cam (109) and, said second handle means (18) being moved to move its segment (60) into contact with said cam (109) to move said lever (22) to the unlatched position.

5. A lock assembly for a door (10) of a vehicle having a latch structure (16) for latching and locking said door (10), said lock assembly comprising a first handle (20) having a lock ring (38) fixed thereon, spaced apart means (42,43) carried by said lock ring (38), stop means (36) carried by said door (10) and extending into position to be contacted by one of said spaced apart means (42,43), a second handle (18) extending from a direction opposite to said first handle (20) and having a latch ring (55) fixed thereon, said latch ring (55) being coaxially aligned with said lock ring (38) and being rotatably mounted relative thereto, means (57) on said latch ring (55) for movement therewith to move a latch means (76) to unlatch said door (10), first spring means (65) for resiliently holding said latch means (76) in the latched position, a pair of means (61,62) on said latch ring (55) with one of said means (61,62) engaging with one of said spaced apart means (43) on said lock ring (38), lever means (22) pivotally mounted relative to said door (10), means (110) on said lever means (22) in alignment with one of said spaced apart means (42,43) on said lock ring (38) when said lever means (22) is in the locked position, second spring means (80) urging said lever means (22) into either a locked or unlocked position, second means (109) on said lever means (22) in contact with one of said means (61,62) on said latch ring (55) when said lever means (22) is in the locked position, whereby placing said lever means (22) in position to align the means (110) on the lever means (22) with one of said spaced apart means (42,43) on said lock ring (38) will prevent the lock ring (38) and the first handle (20) from being moved in either direction and whereby turning the second handle (18) clockwise will move one of said means (61,62) on the latch ring (55) against said second means (109) on the lever means (22) to pivot the lever means (22) and latch means (76) to the unlocked and unlatched position.

6. In a vehicle as claimed in claim 5 wherein said stop means (36) is a lug carried by a plate (35) affixed to said door (10).

7. A lock assembly for a vehicle having a door jam (12), a door (10) having an outside (32) and an inside (26) panel, and a latch structure (16) for latching and locking said door (10) to said door jam (12), said structure (16) comprising a handle (20) extending through said outside panel (32) and having a lock ring (38) keyed thereon, spaced apart ears (42,43) projecting from said lock ring (38), stop means (36) carried by said door (10) and extending into position to be contacted by one ear (43) of said ears (42,43) on said lock ring (38), a second handle (18) extending through said inside panel (26) and having a latch ring (55) keyed thereon, said latch ring (55) being coaxially aligned with said lock ring (38) and being rotatably mounted relative thereto, means (57) on said latch ring (55) for movement therewith to move a latch means (76) to unlatch said door (10) from said jam (12), spring means (65) for resiliently holding said latch means (76) in the latched position, a pair of abutment means (61, 62) on said latch ring (55) with one abutment (62) of said abutment means (61,62) engaging with said one ear (43) of said ears (42,43) on said lock ring (38), lever means (22) pivotally mounted relative to said door (10), means (108) on said lever means (22) in alignment with the other ear (42) of said ears (42,43) on said lock ring (38) when said lever means (22) is in the locked position, a key lock (103), means (89,92) connecting said lever means (22) to said key lock (103), said last-named means (89,92) having operative means (95) engaging with a portion (100) of the key lock (103) either to selectively operate said key lock (103) or to be selectively operated by said key lock (103), second spring means (80) urging said lever means (22) into either a locked or unlocked position, a cam surface (109) on said lever means (22) in contact with one abutment (61) of the abutment means (61,62) when said lever means is in the locked position, whereby locking said key lock (103) will operate to move said lever means (22) into position to align the means (108) on the lever means with the other ear (42) on said lock ring (38) thereby preventing the lock ring (38) and outside handle (20) from moving in either direction and whereby turning the second handle (18) clockwise will move the one abutment (61) of the abutment means (61,62) on the latch ring (55) against said cam surface (109) on the lever means (22) to pivot the lever means (22) and latch means (76) to the unlocked and unlatched position.

8. In a vehicle as claimed in claim 7 wherein said means (57) on said latch ring (55) for unlatching the door (10) comprises a leg (57) mounted on said latch ring (55), a link (69) pivoted to said leg (57), and a bell-crank (72) pivoted to said door (10) and to said link (69) and having a portion (75) adapted to urge the latch means (76) on the door to the unlatched position.

9. In a vehicle as claimed in claim 7 wherein said means (61,62) on the latch ring comprises a collar (60) on said latch ring, said collar having oppositely facing end surfaces (61,62), one of said surfaces (62) engaging one of said means (43) on said lock ring (38) and the other surface (61) engaging either the other means (42) on the lock ring (38) or the cam surface (109) on said lever means (22).

10. In a vehicle as claimed in claim 7 wherein said means (108) on the lever means (22) is an arcuately curved portion terminating at one end in a radial wall (110) and at the other end in said cam surface (109).

11. In a vehicle as claimed in claim 7 wherein said means (89,92) connecting said lever means (22) to said key lock (103) comprises a link (89) pivoted to the intermediate portion of said lever means, a tumbler lever (92) pivoted to the link (89) and having a butterfly opening (95), said portion (100) of said key lock (103) being a bar (100) which seats in said butterfly opening (95) so that turning the key in the key lock (103) to the locked position engages the bar (100) with part of the butterfly opening (95) to turn the tumbler lever (92), move the link (89) and pivot the lever means (22) to the locked position.

12. In a vehicle as claimed in claim 7 wherein said second spring means (90) is connected at one end to said intermediate portion of the lever means (22) and is connected at its other end to said door (10), the center line of said spring means (80) crossing the center line of the lever means (22) whereby movement of the lever means (22) will move the center line of the spring means (80) from one side of the center line of the lever means (22) to the other to urge and retain the lever means (22) in the locked or unlocked position.

13. In a vehicle as claimed in claim 9 wherein said means (108) on said lever means (22) is a cutout portion (108) having a radial wall (110) which aligns with and engages said other ear (42) on said lock ring (38), the cutout portion (108) having an arcuate shape (111) merging with said cam surface (109), said cam surface (109) projecting between said other ear (42) on said lock ring (38) and said other contact (61) on said collar (60) when said lever means (22) is in the locked position.

14. A door locking assembly for a vehicle having a door (10), a door jam (12) and a door latch structure (16) for latching the door (10) to said door jam (12), said latch structure (16) comprising a handle (20) pivotably secured on an outside panel (32) of said door (10) and having a portion (34) extending into a cavity in said door, a lock ring (38) in said cavity keyed on said portion (34) of the handle (20) and having two spaced apart ears (42,43) extending radially outward from said lock ring (38), a lug (36) carried by said outside panel (32) and extending into position to be contacted by one of said ears (43) on said lock ring (38), a bushing (48) keyed on said portion (34) of the handle (20) and abutting said lock ring (38), a second handle (18) secured on an inside panel (26) of the door (10) and having a portion (52) extending through said panel (26) into said cavity in the door (10), a latch ring (55) keyed on said portion (52) and encircling said bushing (48) so that said handles (18,20) can be rotated relative to each other, means (57,69,72) actuated by said latch ring (55) for unlatching said door (10) from said jam (12), spring means (65) connected to said latch ring (55) for returning said means (57,69,72) for unlatching said door (10) and said handle to the latched position, abutment means (61,62) on said latch ring (55) engaging with one ear (43) on said lock ring (38) to urge said ear (43) against said lug (36) carried by said outside panel (32), lever means (22) pivotally mounted at one end portion to said door and having another end portion projecting through an opening (24) in said door (10), means (108) on said lever means (22) in alignment with the other of said ears (42) on said lock ring (38) when said lever means (22) is in the locked position, a key lock (103) carried by said outside door panel (32), a bar (100) on said key lock (103), a tumbler lever (92) having a butterfly-shaped opening (95) receiving said bar (100), means (89) for connecting said lever means (22) to said tumbler lever (92), a spring (80) urging said lever means (22) into either a locked or unlocked position, whereby locking said key lock (103) with a key (104) will pivot the bar (100) clockwise to pivot the tumbler lever (92) and lever means (22) until said spring (80) goes over center whereupon the spring (80) will pull the lever means (22) to the locked position with said means (108) on the lever means (22) aligned with the other ear (42) on said lock ring (38) thereby preventing the lock ring (38) and outside handle (20) from moving in either direction, and whereby turning the inside handle (18) clockwise will move one abutment (61) of said abutment means (61,62) on the latch ring (55) against a cam means (109) on the lever means (22) to pivot the lever means (22) counterclockwise until the spring (80) thereon goes over center to move the lever means (22) to the unlocked position as the means actuated by said latch ring (55) unlatches the door.

15. A door locking assembly as claimed in claim 14 wherein said means (108) on the lever means (22) is a cutout portion (108) having a wall (110) which aligns with said other of said ears (42) on the lock ring (38) when the lever means (22) is in the locked position whereby said outside handle (20) cannot be turned.

16. A door locking assembly as claimed in claim 14 wherein said means for connecting said lever means (22) to the tumbler lever (92) comprises a link (89) connected between an intermediate portion of said lever means (22) and the end portion of the tumbler lever (92) spaced from said butterfly-shaped opening (95) therein.

17. A door locking assembly as claimed in calim 14 wherein said spring (80) urging said lever means (22) comprises an elongate coil spring (80) connected at one end to the intermediate portion of the lever means (22) and connected at the other end to said outside door panel (32), said lever means (22) having an axis on the center line thereof, and said spring having an axis on the center line thereof whereby when the axis of the spring (80) moves from one side of the axis of said lever means (22) to the other said spring (80) will accentuate the continued movement of said lever means.

18. A door locking assembly as claimed in claim 14 wherein said cam means (109) on said lever means (22) is a cam surface (109) projecting outwardly from one edge of said lever means (22), said cam surface (109) extending into overlapping relationship with one of said abutment means (61) on said latch ring (55) when the lock (103) is in locked position, said abutment means (61) moving said cam surface (109) and said lever means (22) when said inside handle (18) is turned.

19. A door locking assembly as claimed in claim 14 wherein a plate (35) is mounted on the inside of said outside door panel (32), said plate (35) has an inturned tab (66) to which said spring means (65) is attached, said plate (35) has a platform (82) with a projection (81) to which said spring (80) is attached, said plate (35) has a boss (78) to which said lever means (22) is pivotally mounted and said plate (35) has said lug (36) mounted thereon in the path of movement of said ear (43) of said lock ring (38).

20. A lock assembly for a door (10) of a vehicle having a latch structure (16) for latching and locking said door (10), said lock assembly comprising a first handle (20) having a lock ring (38) fixed thereon, spaced apart ear means (42,43) carried by said lock ring (38), stop means (36) carried by said door (10) and extending into position to be contacted by one of said spaced apart ear means (42, 43), a second handle (18) extending from a direction opposite to said first handle (20) and having a latch ring (55) fixed thereon, said latch ring (55) being coaxially aligned with said lock ring (38) and being rotatably mounted relative thereto, means (57) operatively carried by said latch ring (55) for movement therewith to move a latch means (76) to unlatch said door (10), first spring means (65) for resiliently holding said latch means (76) in the latched position, a pair of abutment means (61,62) on said latch ring (55) with one of said abutment means (61, 62) engaging with one of said spaced apart abutment means (43) on said lock ring (38), lever means (22) pivotally mounted relative to said door (10), means (110) operatively carried by said lever means (22) in alignment with one of said spaced apart ear means (42,43) on said lock ring (38) when said lever means (22) is in the locked position, second spring means (80) urging said lever means (22) into either a locked or unlocked position, second means (109) operatively carried by said lever means (22) in alignment with one of said abutment means (61,62) on said latch ring (55) when said lever means (22) is in the locked position, whereby placing said lever means (22) in position to align the means (110) on the lever means (22) with one of said spaced apart ear means (42,43) on said lock ring (38) will prevent the lock ring (38) and the first handle (20) from being moved in either direction and whereby turning the second handle (18) clockwise will move one of said abutment means (61,62) on the latch ring (55) against said second means (109) on the lever means (22) to pivot the lever means (22) and latch means (76) to the unlocked and unlatched position.

* * * * *